US005494348A

United States Patent [19]

Grabher

[11] Patent Number: 5,494,348

[45] Date of Patent: Feb. 27, 1996

[54] DRAWER WITH FASTENER FOR A DRAWER BOTTOM

[75] Inventor: Guenter Grabher, Fussach, Austria

[73] Assignee: Grass AG, Hochst/Vlbg., Austria

[21] Appl. No.: 157,680

[22] Filed: Nov. 24, 1993

[30] Foreign Application Priority Data

Dec. 3, 1992 [DE] Germany ..... 9216508 U

[51] Int. Cl.[6] ..... A47B 88/00

[52] U.S. Cl. ..... 312/348.1; 312/263

[58] Field of Search ..... 312/348.1, 348.2, 312/263, 334.14, 334.15

[56] References Cited

U.S. PATENT DOCUMENTS 4,173,379 11/1979 Heiden et al. ..... 312/257.1
4,842,351 6/1989 Rock et al. ..... 312/263
5,147,123 9/1992 Berger ..... 312/348.1

FOREIGN PATENT DOCUMENTS 3911353 10/1990 Germany ..... 312/348.1

*Primary Examiner*—Peter M. Cuomo
*Assistant Examiner*—Gerald A. Anderson
*Attorney, Agent, or Firm*—Petree Stockton

[57] ABSTRACT

A drawer includes side walls formed as integrated concealed slides which are detachably fastenable to a drawer bottom. The lower edge of each integrated concealed slide respectively forms an upwardly open groove, in which a vertical downward projecting exposed shank of the drawer bottom engages. In order to fasten the integrated concealed slide to the drawer bottom, the vertical side wall of each integrated concealed slide is provided with a bendable joining clip, which engages through a corresponding opening in the vertical shank of the drawer bottom and engages against the underside of the drawer bottom.

5 Claims, 1 Drawing Sheet

DRAWER WITH FASTENER FOR A DRAWER BOTTOM

FIELD AND BACKGROUND OF THE INVENTION

The present invention relates to a drawer and more particularly to a drawer with integrated concealed drawer slides which each define a drawer side wall and with an easily detachable drawer bottom. This type of drawer must be easily collapsible and easily assembled. Therefore, it is necessary that the drawer bottom must be fastened with the integrated concealed slide which forms the drawer side wall as quickly and easily as possible.

SUMMARY OF THE INVENTION

An object of the invention is to provide a drawer with a fastener for a drawer bottom that, in addition to a convenient assembly of the drawer in connection with a drawer bottom, also provides a convenient fastening of the drawer bottom to the drawer side wall.

Another object of the invention is to provide a quick connection, for example, between components, namely integrated concealed slides and a drawer bottom, both formed of powder-coated sheet steel.

The drawer bottom, which is formed as a bottom plate or floor panel, is set in an upwardly open groove of the respective integrated concealed slides, and both integrated concealed slides are pressed against downwardly projecting shanks of the drawer bottom. Afterwards, a tab is pressed out of a vertical side portion of the upwardly open groove of each of the integrated concealed slides and inserted through a corresponding opening in a downwardly projecting shank of the drawer bottom. Preferably, the drawer bottom is pressed upwardly against a wipe lip formed on the inner side of the drawer side wall which bears against the upper side of the drawer bottom and as a result of this outer bearing, the joining clip fits snugly to the underside of the drawer bottom.

This outline focuses on the more important features of the invention in order that a detailed description which follows may be better understood and in order that the present contribution to the art may be better appreciated. There are additional features of the invention which will be described hereinafter and which will form the subject matter of the claims appended hereto. It is understood that the invention is not limited in its application to the details of construction and to the arrangement of the components set forth in the following description and drawings. The invention is capable of other embodiments and of being practiced and being carried out in various ways. It is to be further understood that the phraseology and terminology employed herein are for the purpose of description and are not regarded as limiting. Those skilled in the art will appreciate that the conception upon which this disclosure is based may readily be utilized as a basis for designing the structures, methods and systems for carrying out the several purposes of the present invention. The claims are regarded as including such equivalent construction so long as the do not depart from the spirit and scope of the present invention.

BRIEF DESCRIPTION OF THE DRAWINGS

The invention will be better understood and objects other than those set forth above will become apparent when consideration is given to the following detailed description.

Such description makes references to the annexed drawings wherein.

DETAILED DESCRIPTION OF THE PREFERRED EMBODIMENT

The side walls of the drawer consist of two mirror-symmetrical integrated concealed slides (1,2) according to a known method in which each integrated concealed slide includes a downward projecting vertical side wall (15), which in its lower area has an upwardly open groove (3).

Figures 1, 2:
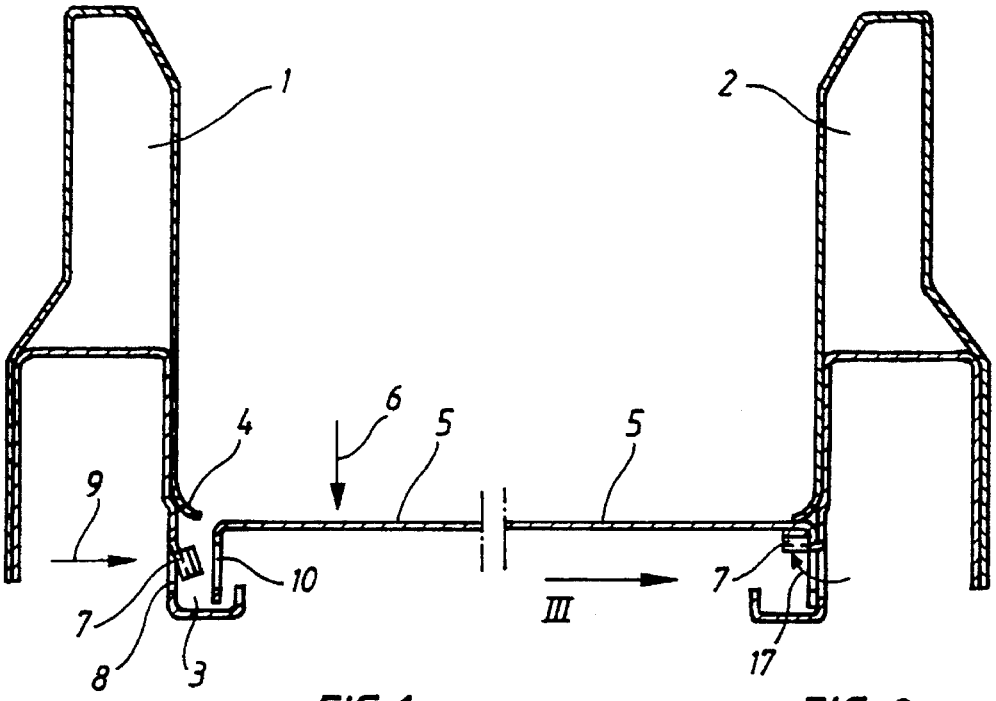
FIG. 1 is a sectional view through the left side of a drawer according to the invention with the bottom detached.
FIG. 2 is a sectional view through the right side of a drawer according to the invention with the bottom attached.
Figure 3:
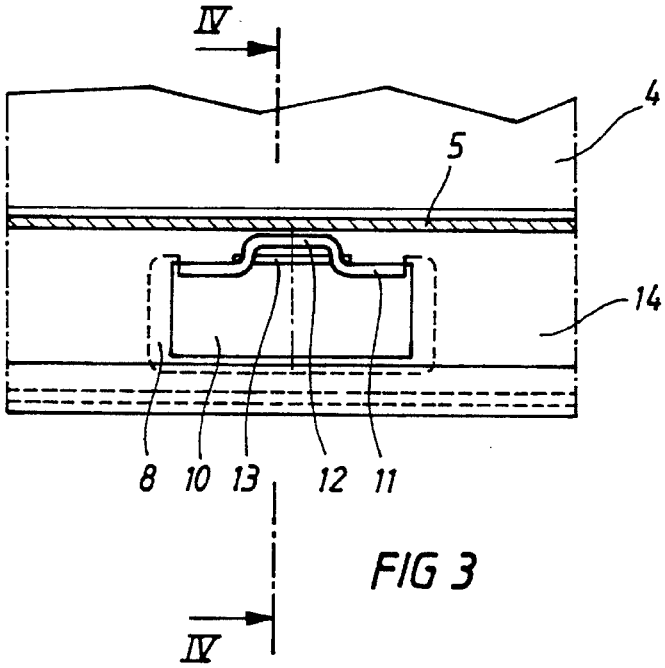
FIG. 3 is a detail view according to arrow 3 in FIG. 2.

The drawer bottom (5) has a somewhat C-shaped profile and forms a vertical downward projecting shank (14), which, according to FIG. 1 is set in the upwardly open groove (3) of the respective integrated concealed slides (1,2) in the arrow direction (6).

The lower vertical side wall (15) is designed with an opening (8), from which a tab (11) projects. This tab (11) extends on one side of the material of the side wall (15) and is flexible around a horizontal axis.

On the front exposed end of this tab (11), a joining clip (7) is formed, which includes a joining clip component (12) pressed out of the material of the tab (11) and which projects upwardly above the plane of the tab (11).

In the vertical shank (14) of the drawer bottom (5), respective openings (10) are formed which are substantially aligned with the respective openings (8).

Above each groove (3) on the inner side of each drawer side wall defined by the integrated concealed slides (1,2), a respective wipe lip (4) is formed.

In order to assemble the drawer, the drawer bottom is placed in the arrow direction (6) with its vertical shanks (14) in respective grooves (3). Both integrated concealed slides (1,2) are pressed against each other in arrow direction (9), so that the vertical shanks (14) of the drawer bottom fit against the vertical side walls (15) of the respective integrated concealed slides with openings (8, 10) superimposed.

Figure 4:
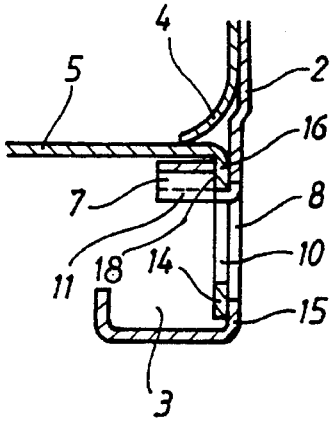
FIG. 4 is a sectional view according to line 4—4 in FIG. 3.

Next the joining clip (7) is bent with a tool or manually in arrow direction 17 from an undeflected or unbent position to a highly bent position which is shown in FIGS. 2 and 4. Joining clip (7) then engages through the opening (10) in the shank (14) of the drawer bottom (5); and simultaneously, a vertical downward directed projection (16) having a back-side (18) as shown in FIG. 4 engages with its lower edge (13) behind the clip component (12) of the joining clip (7) and with clip component (12) engaged against back side (18) of downwardly directed projection (16). In this manner the drawer bottom (5) is secured against shifting in arrow direction (9) and also in the opposite direction.

To prevent shifting in the direction perpendicular to the arrow direction (9) (in the plane of projection of FIGS. 1, 2) the width of the clip component (12) is slightly larger than the width of edge (13), which lies behind clip component (12), and which corresponds with the width of the notch (10). The lateral edges of joining clip (7) resting against the marginal sides of the opening (10) prevent the drawer bottom (5) from shifting.

What is claimed is:

1. A drawer comprising: an integrated concealed drawer slide having portions defining a drawer side wall with a lower area, the lower area having an upwardly open groove with a vertical side portion;

a drawer bottom having an underside and with a substantially vertically downwardly projecting drawer bottom shank which engages in the upwardly open groove, the drawer bottom shank having portions defining an opening through the shank;

a joining clip formed in the vertical side portion of the upwardly open groove receivable though the shank opening and said joining clip being formed from a tab pressed out of said vertical side potion of the upwardly open groove;

an upwardly projecting clip component formed in said joining clip which engages against said drawer bottom underside, said drawer bottom shank including a vertical downwardly directed projection at least partially defining said shank opening and having a back side, and said upwardly projecting clip component engaging against the back side of the vertical downwardly directed projection, said drawer side wall having an inner side provided with a wipe lip disposed proximate said upwardly open groove, said drawer bottom having an upper side, and the wipe lip engages against said drawer bottom upper side.

2. The drawer according to claim 1, said vertical downwardly directed projection of said drawer bottom shank having a predetermined thickness, said joining clip is flexibly bent on a joining clip bending axis, and said upwardly projecting clip component is spaced from the joining clip bending axis by a distance at least as great as the thickness of the vertical downwardly directed projection of the drawer bottom shank.

3. The drawer according to claim 2, wherein said upwardly projecting clip component is spaced from the joining clip bending axis by a distance greater than the thickness of the vertical downwardly directed projection of the drawer bottom shank.

4. The drawer according to claim 3, said tab having opposing lateral edges spaced from each other by a predetermined distance, and said shank opening having opposing sides spaced from each other by a distance at least as great as the distance between the tab edges.

5. The drawer according to claim 4, wherein said shank opening opposing sides are spaced from each other by a distance substantially the same as the distance between the tab edges.

* * * * *